US010048032B1

(12) United States Patent
Lazar et al.

(10) Patent No.: US 10,048,032 B1
(45) Date of Patent: Aug. 14, 2018

(54) CHILD SAFETY WEAPON LOCKS

(71) Applicant: Scott Wilson Design, Ltd., Chicago, IL (US)

(72) Inventors: Eli Lazar, Urbana, IL (US); Scott H. Wilson, Chicago, IL (US); Gary H. Paulsen, Chicago, IL (US); Kyle Buzzard, Lombard, IL (US)

(73) Assignee: Scott Wilson Design, Ltd., Chicago, IL (US)

( * ) Notice: Subject to any disclaimer, the term of this patent is extended or adjusted under 35 U.S.C. 154(b) by 0 days.

(21) Appl. No.: 15/643,006

(22) Filed: Jul. 6, 2017

Related U.S. Application Data

(60) Provisional application No. 62/507,429, filed on May 17, 2017, provisional application No. 62/472,929, filed on Mar. 17, 2017.

(51) Int. Cl.

| | |
|---|---|
| ***F41A 17/54*** | (2006.01) |
| ***F41A 17/46*** | (2006.01) |
| ***F41A 17/44*** | (2006.01) |
| *F41A 17/00* | (2006.01) |

(52) U.S. Cl.
CPC ..... *F41A 17/54* (2013.01); *F41A 17/44* (2013.01); *F41A 17/46* (2013.01); *F41A 17/00* (2013.01)

(58) Field of Classification Search
CPC ..... F41A 17/00; F41A 17/44; F41A 17/46; F41A 17/54; B65D 2215/04
See application file for complete search history.

(56) References Cited

U.S. PATENT DOCUMENTS

| | | | | |
|---|---|---|---|---|
| 3,256,723 | A * | 6/1966 | Lehman | E05B 37/16 70/25 |
| 4,575,141 | A * | 3/1986 | Burns | E05B 13/002 292/336.3 |
| 4,794,768 | A * | 1/1989 | Moser | B60K 15/0409 70/165 |
| 4,934,083 | A * | 6/1990 | Smith | F41A 17/54 42/70.07 |
| 5,191,158 | A | 3/1993 | Fuller et al. | |
| 5,239,767 | A * | 8/1993 | Briley, Jr. | F41A 17/44 42/70.11 |
| 5,544,440 | A * | 8/1996 | Stockman | F41A 17/54 42/70.06 |
| 5,561,935 | A | 10/1996 | McCarthy et al. | |
| 5,704,152 | A * | 1/1998 | Harrison | F41A 17/04 42/70.07 |

(Continued)

OTHER PUBLICATIONS

Gun Locks, Order Page, Master Lock Company LLC, 2016.

(Continued)

*Primary Examiner* — Stephen Johnson
*Assistant Examiner* — Joshua T Semick
(74) *Attorney, Agent, or Firm* — Neal, Gerber & Eisenberg LLP

(57) ABSTRACT

Child safety weapon locks are disclosed. The child safety weapon lock includes a detente housing, a locking shaft assembly, and a radial lever. The locking shaft assembly is engaged with the detente housing. The radial lever is engaged with the detente housing and selectively engaged with the locking shaft assembly. The radial lever selectively captures the locking shaft assembly between the radial lever and the detente housing.

19 Claims, 13 Drawing Sheets

(56) References Cited

U.S. PATENT DOCUMENTS

| | | | | |
|---|---|---|---|---|
| 5,899,102 | A * | 5/1999 | Ling | E05B 37/025 42/70.06 |
| 6,269,575 | B1 * | 8/2001 | Chang | F41A 17/54 42/70.07 |
| 6,405,469 | B1 | 6/2002 | Walsh | |
| 6,418,653 | B1 | 7/2002 | Bowles | |
| 6,510,640 | B2 * | 1/2003 | Strong | F41A 17/54 42/70.01 |
| 7,216,449 | B2 | 5/2007 | Riebling et al. | |
| 7,421,814 | B2 | 9/2008 | Peles | |
| 9,394,724 | B2 * | 7/2016 | Herdman | E05B 73/00 |
| 9,448,025 | B2 * | 9/2016 | Farr | F41A 17/54 |
| 2010/0032966 | A1 * | 2/2010 | Taglianetti | E05B 1/0046 292/217 |
| 2013/0256331 | A1 * | 10/2013 | Giraud | B65D 83/0409 221/1 |
| 2015/0033609 | A1 * | 2/2015 | Herdman | F41A 23/18 42/70.07 |
| 2016/0054080 | A1 | 2/2016 | Haimi | |

OTHER PUBLICATIONS

Keyed Trigger Lock, Product Specification and Order Page, Franzen International Security Products, Inc., 2017.

Master 90 Gun Lock, Instruction Page, Master Lock Company LLC, 1999.

Thatcher, "Trigger lock created by Lake Havasu inventor," Cronkite News, Feb. 3, 2016.

* cited by examiner

CHILD SAFETY WEAPON LOCKS

RELATED APPLICATION

This application claims the benefit of U.S. Provisional Application Nos. 62/472,929 filed on Mar. 17, 2017 and 62/507,429 filed on May 17, 2017.

FIELD OF THE DISCLOSURE

This disclosure relates generally to access restriction devices, and, more particularly, to child safety weapon locks.

BACKGROUND

Weapons (e.g., firearms, air rifles, spearguns, etc.) are often actuated via a trigger. When the trigger is moved with respect to a body of the weapon (e.g., squeezed by a finger toward a hand grip), potential energy (e.g. chemical and/or kinetic) stored in the weapon is released (e.g., fired) to propel a projectile away from the weapon.

Access to weapons is often needed quickly; however, when a weapon is not in use, access to the weapon is optimally restricted to authorized adults. To prevent unauthorized users (e.g., children) from actuating (e.g., firing) the weapon, a weapon lock is often engaged with the trigger. Known weapon locks are often paired with a key or other device to remove the weapon lock from a weapon, but are not otherwise resistant to disengagement (e.g., child-resistant). Thus, quick access to the weapon by an authorized user is hindered. Additionally, known weapon locks allow trigger movement (e.g., trigger wiggle) which may lead to discharge of the weapon even when locked.

SUMMARY

An example safety apparatus for a weapon is disclosed. The example safety apparatus includes a detent housing, a locking shaft assembly, and a radial lever. The locking shaft assembly is engaged with the detent housing. The radial lever is engaged with the detent housing and selectively engaged with the locking shaft assembly to selectively capture the locking shaft assembly between the radial lever and the detent housing.

An example apparatus for locking a firearm is disclosed. The example apparatus includes a locking shaft, a bearing, a detent housing, a radial lever, and an axial spring. The locking shaft includes a first shaft tab at a first shaft end of the locking shaft. The bearing is about and rotatably engaged with the locking shaft. The detent housing is rotatably engaged with the bearing and includes a detent tab to engage the first shaft tab. The radial lever is engaged with the detent housing to selectively block sliding movement of the bearing in the detent housing. The axial spring is engaged with the detent housing to urge the detent housing away from the locking shaft.

An example method to disengage a child safety lock is disclosed herein. The example method includes: depressing a first detent button of a first portion of the child safety lock; compressing a detent housing of the first portion toward a second portion of the child safety lock; and rotating the detent housing relative to the second portion.

The figures are not to scale. Wherever possible, the same reference numbers will be used throughout the drawings and accompanying written description to refer to the same or like parts. As used in this patent, stating that any part (e.g., a layer, film, area, plate, or assembly) is in any way positioned on (e.g., positioned on, located on, disposed on, or formed on, etc.) another part, means that the referenced part is either in contact with the other part, or that the referenced part is connected to the other part via one or more intermediate part(s) located therebetween. Stating that any part is in contact with another part means that there is no intermediate part between the two parts.

DETAILED DESCRIPTION

Figure 1:
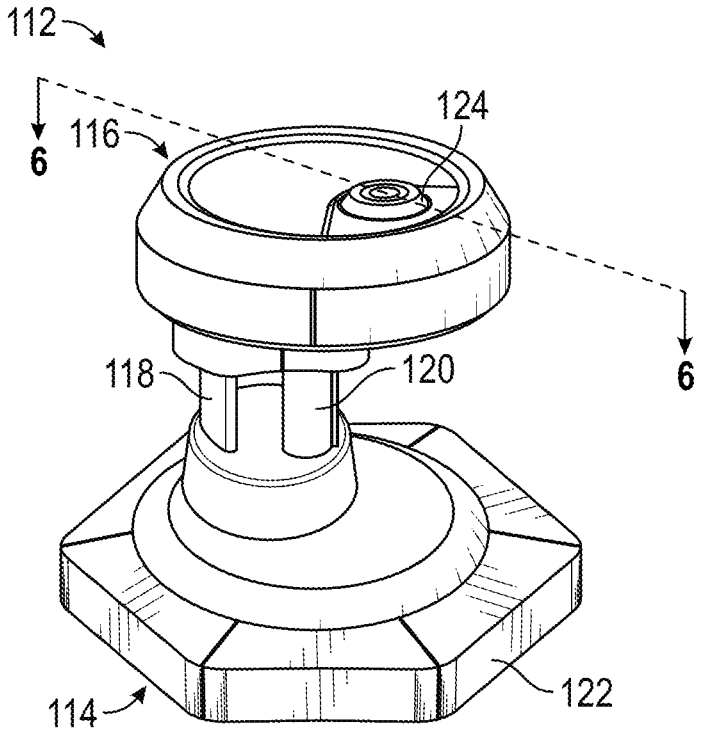
FIG. 1 illustrates a weapon lock in a locked state as disclosed herein.

FIG. 1 illustrates a weapon lock 112 in a locked state as disclosed herein. In the illustrated example of FIG. 1, the weapon lock 112 includes a first portion 114 and a second portion 116. The first portion includes a trigger stop 118, a locking shaft assembly 120, and a grip 122. In some examples, the second portion includes an optional key lock 124. The trigger stop 118 and the locking shaft assembly 120 are engaged with the second portion 116 to secure the second portion 116 to the first portion 114. In some examples, the key lock 124 engages the locking shaft assembly 120 to prevent unauthorized separation of the first portion 114 from the second portion 116. In the illustrated example of FIG. 1, the grip 122 is shown as hexagonal, although the grip 122 may be any shape (e.g., polygonal, circular, ovoid, etc.). In some examples, the grip 122 is as wide as the outstretched fingers of an adult human hand (for example, in a range between approximately 4 inches to approximately 7 inches) between opposing sides or between a side and an opposing vertex. Thus, in some such examples, a child would be unable to grasp opposing sides and/or vertices of the grip 122 with a single hand.

In operation, to release the first portion from the second portion, opposing sides and/or vertices of the grip 122 are squeezed towards one another, the first portion 114 is compressed toward the second portion 116, and the first portion 114 is rotated relative to the second portion 116, as will be described in further detail in conjunction with FIGS. 6-8. In operation, to restrict separation of the weapon lock 112 by children but permit separation of the weapon lock by any adult, the key lock 124 may be left disengaged from the locking shaft assembly 120. Thus, a weapon secured only via the weapon lock 112 may be quickly accessed by an adult while remaining inaccessible to children. However, if desired, the key lock 124 provides a secondary locking feature blocking access to adults.

In the illustrated example of FIG. 1, a section line 6-6 is shown. FIG. 6, a cross sectional view of FIG. 1 described in greater detail below, is taken along section line 6-6.

Figure 2:
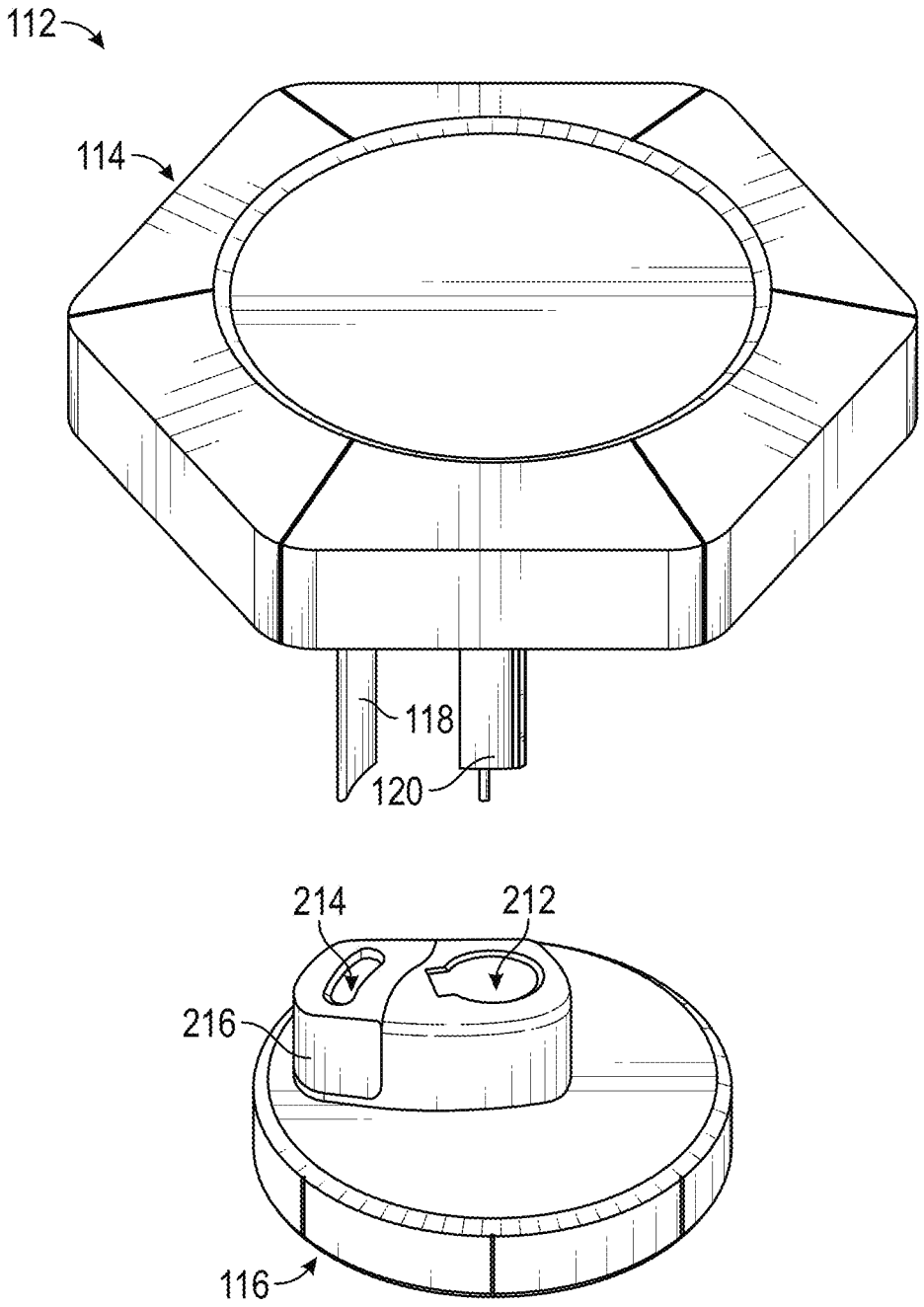
FIG. 2 illustrates the weapon lock of FIG. 1 in an unlocked state with a first portion of the weapon lock separated from a second portion of the weapon lock.

FIG. 2 illustrates the weapon lock of FIG. 1 in an unlocked state with the first portion of the weapon lock separated from the second portion of the weapon lock. In the illustrated example of FIG. 2, the first portion further includes a first cavity 212, a second cavity 214, and first escutcheon 216. The first escutcheon 216 has a first escutcheon opening 218 in communication with the second cavity 214. The first cavity 212 is shaped to correspond and engage (e.g., receive) with the locking shaft assembly 120. The second cavity 214 is shaped to correspond and engage with the trigger stop 118.

Figure 3:
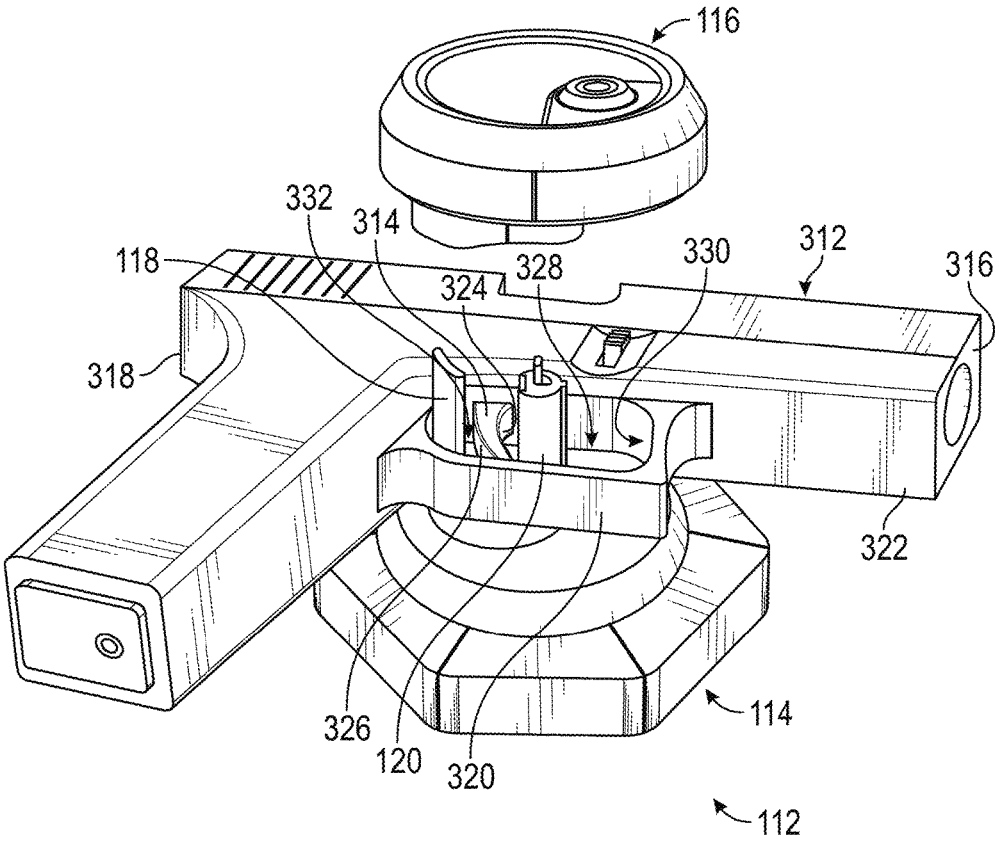
FIG. 3 illustrates the first portion of FIGS. 1 and 2 engaged with a weapon and separated from the second portion of FIGS. 1 and 2.

FIG. 3 illustrates the first portion 114 of FIGS. 1 and 2 engaged with an example weapon 312 and separated from the second portion 116 of FIGS. 1 and 2. In the illustrated example of FIG. 3, the weapon 312 includes a trigger 314, a front end 316, a rear end 318, a trigger guard 320, and a body 322. The trigger 314 includes a front side 324 and a rear side 326. The trigger guard 320 and the body 322 define a finger opening 328. The trigger 314 divides the finger opening 328 into a forward space 330 (e.g., in front of the trigger 314) and an aft space 332 (e.g., behind the trigger 314).

In the illustrated example of FIG. 3, the trigger 314 is pivotably engaged with the body 322 to fire a projectile (e.g., a bullet) (not pictured) from the weapon 312 via the front end 316. The trigger guard 320 is engaged with the body 322 to shield the trigger 314 from accidental contact with objects (e.g., a holster, a case, a pocket, etc.) that may cause the trigger 314 to pivot in relation to the body 322 and fire the weapon 312. The trigger guard 320 is formed to permit an adult finger (e.g., a trigger finger, an index finger, etc.) to pass through the finger opening 328 and selectively engage the front side 324 of the trigger 314.

In operation, to lock the example weapon 312, the trigger stop 118 and the locking shaft assembly 120 are inserted through the finger opening 328 and the second portion 116 of the weapon lock 112 is engaged with the trigger stop 118 and the locking shaft assembly 120, as shown in FIG. 1. More specifically, the trigger stop 118 is inserted through the aft space 332 of the finger opening 328 to engage the rear side 326 of the trigger 314. When inserted in the finger opening 328, the trigger stop 118 also engages the trigger guard 320 and/or the body 322. Further, the locking shaft assembly 120 is inserted through the forward space 330 of the finger opening 328 to engage the front side 324 of the trigger 314. When inserted in the finger opening 328, the locking shaft assembly 120 also engages the trigger guard 320 and/or the body 322. Thus, the trigger stop 118 serves to substantially prevent movement of the trigger 314 toward the rear end 318. Further, the locking shaft assembly serves to substantially prevent movement of the trigger 314 toward the front end 316. In other words, the trigger stop 118 and the locking shaft assembly 120 work together to substantially immobilize the trigger 314 with respect to the body 322. Additionally, when the second portion 116 is engaged with the first portion 114, the finger opening 328 is substantially covered. Thus, when the weapon lock 112 is locked onto the weapon 312, the trigger 314 is held substantially stationary with respect to the body 322 and access to the trigger 314 is restricted.

In some examples, a trigger of a specialty weapon (not pictured) slides in relation to a body of the specialty weapon, thus limiting a finger opening of the specialty weapon to a forward space similar to the forward space 330 of FIG. 3. In some such examples, the trigger stop 118 is shaped (e.g., slotted) to engage one or more openings in the trigger of the specialty weapon.

Further, provided there is an opening behind and/or in a trigger for the trigger stop to insert through, it should be understood that the weapon lock 112 may be used with any type of trigger-actuated weapon (e.g., a firearm, a compressed gas arm, an electromagnetic projectile launcher, a crossbow, a spring-loaded arm, etc.) or tool (e.g., a power tool).

Figure 4:
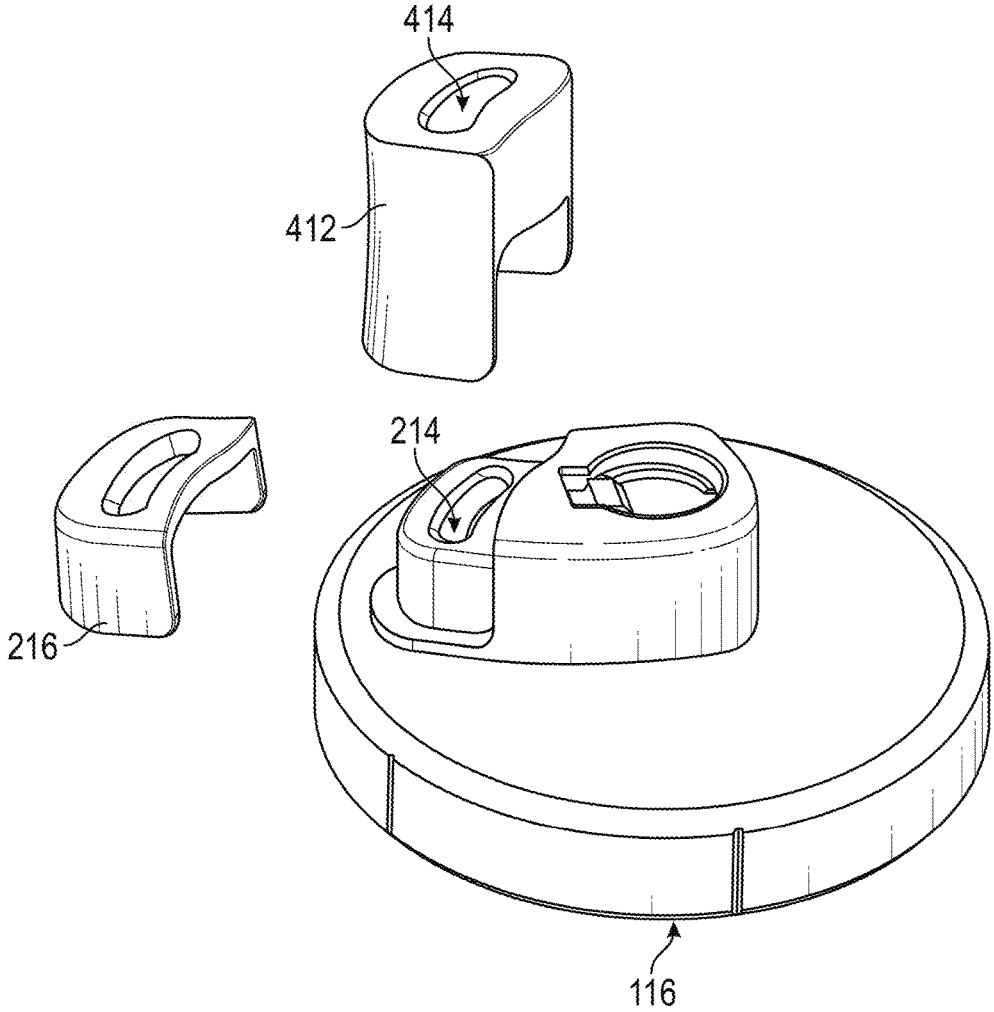
FIG. 4 illustrates a first escutcheon removed from the second portion of FIGS. 1-3 and a second escutcheon to replace the first escutcheon.

FIG. 4 illustrates the first escutcheon 216 removed from the second portion 116 of FIGS. 1-3 and a second escutcheon 412 to replace the first escutcheon 216. In the illustrated example of FIG. 4, the second escutcheon 412 has a second escutcheon opening 414. The second escutcheon 412 is shaped to engage with the second portion 116 and to substantially fill the aft space 332 of FIG. 3. It should be appreciated that the second escutcheon 412 may be shaped to substantially fill an aft space behind a trigger of any make and model of weapon. In operation, the trigger stop 118 of FIGS. 1-3 passes through the second escutcheon opening 414 to engage the second portion 116 via the second cavity 214. It should also be understood that the second escutcheon 412 is optional. For example, where a weapon has a relatively narrow aft space behind a trigger of the weapon, the first escutcheon 216 may be engaged with the second portion 116, instead of the second escutcheon 412. Moreover, various sized escutcheons could be offered to accommodate the aft spaces of triggers in specific weapons.

Figure 5:
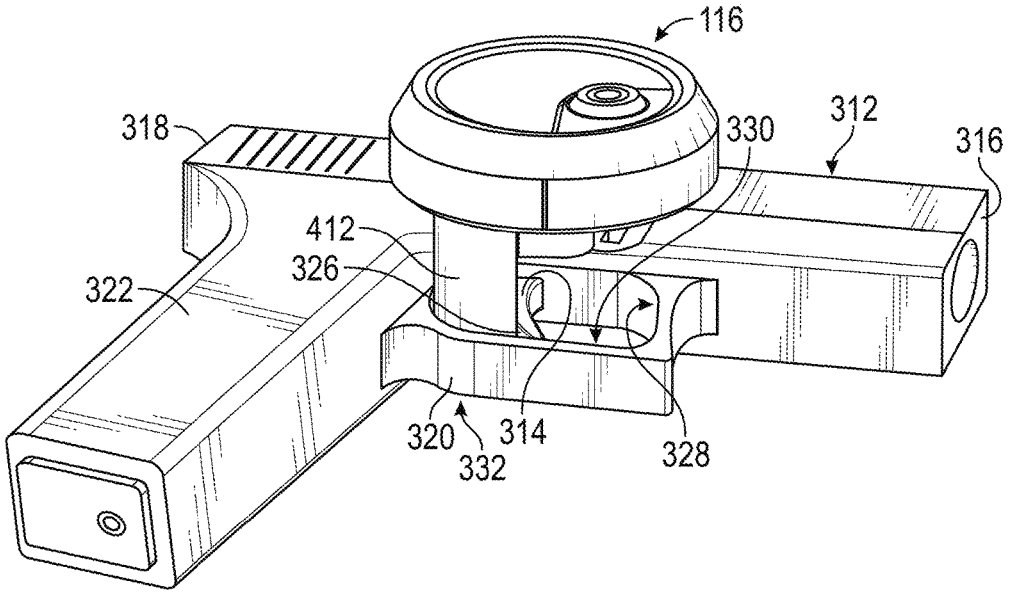
FIG. 5 illustrates the second escutcheon of FIG. 4 installed on the second portion of FIGS. 1-4 and engaged with the weapon of FIG. 3.

FIG. 5 illustrates the second escutcheon 412 of FIG. 4 installed on the second portion 116 of FIGS. 1-4 and engaged with the weapon 312 of FIG. 3. In the illustrated example of FIG. 5, the second escutcheon 412 engages the rear side 326 of the trigger 314, the body 322, and the trigger guard 320 to substantially fill the aft space 332. Thus, the second escutcheon 412 substantially prevents the trigger 314 from pivoting toward the rear end 318.

Figure 6:
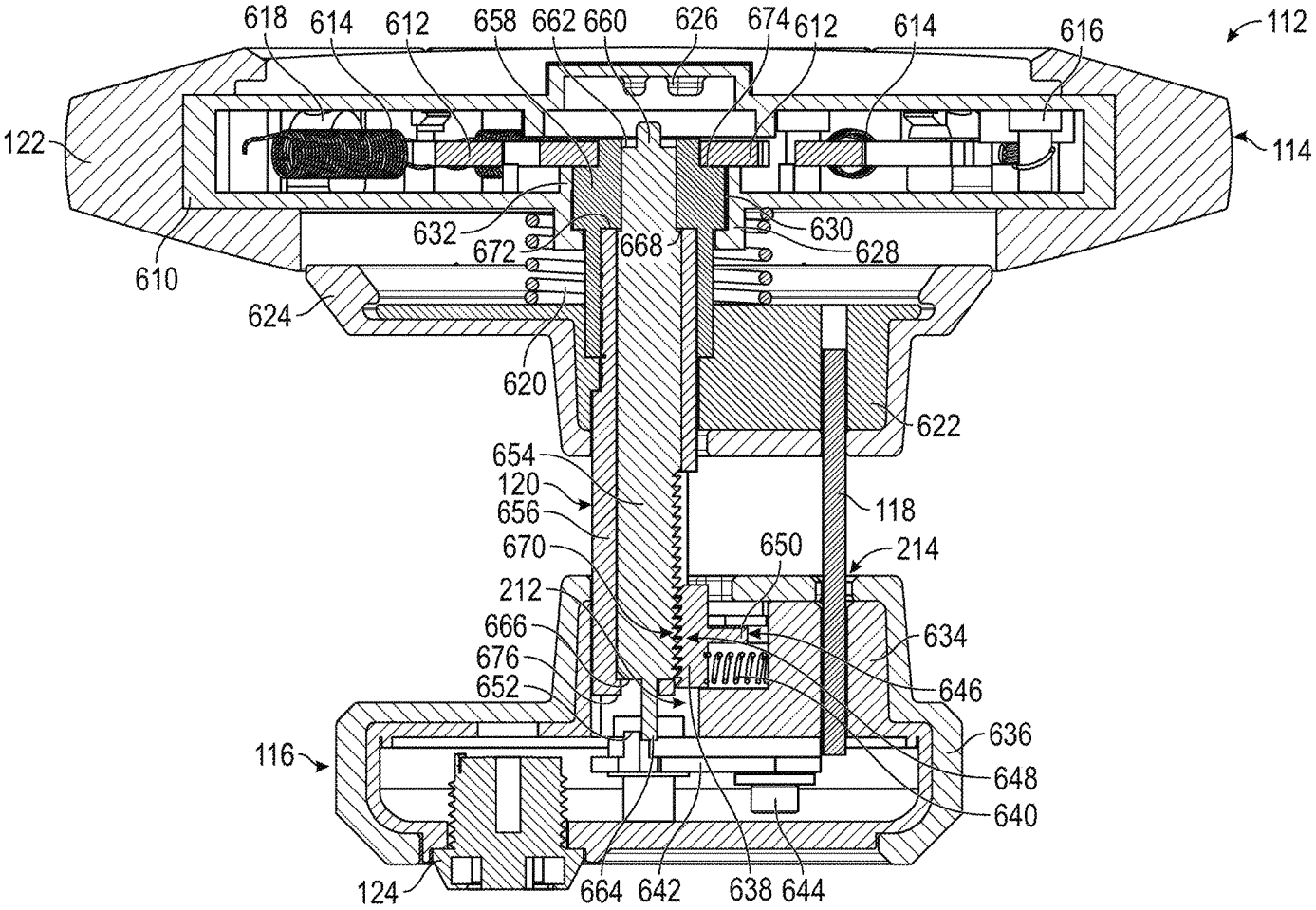
FIG. 6 is a cross-sectional view of the weapon lock along section line 6-6 of FIG. 1.

FIG. 6 is a cross-sectional view of the weapon lock 112 along section line 6-6 of FIG. 1. In the illustrated example of FIG. 6, the first portion 114 further includes a detent housing 610, a plurality of radial levers 612, a plurality of radial springs 614, a plurality of radial anchor pins 616, a plurality of detent buttons 618, an axial spring 620, an intermediate housing 622, and an intermediate boot 624. As shown in FIG. 6, the detent housing 610 includes at least one detent tab 626, an internal detent shoulder 628, a slideway 630, and a lip 632. In the example cross-sectional view of FIG. 6, taken along section line 6-6 of FIG. 1, two of a plurality of detent tabs 626 are visible.

In the illustrated example of FIG. 6, the second portion 116 further includes a receiver housing 634, a receiver boot 636, a pawl 638, a pawl spring 640, a lock plate 642, and a lock plate fastener 644. As shown in FIG. 6, the first cavity 212, the second cavity 214, and a pawl slot 646 are formed in the receiver housing 634. Further shown in FIG. 6, the pawl 638 includes a set (e.g., one or more) of pawl teeth 648, and a pawl tab 650. The lock plate 642 includes a catch 652.

In the illustrated example of FIG. 6, the locking shaft assembly 120 includes a locking shaft 654, a sleeve 656, and a bearing 658. Additionally illustrated in FIG. 6, the locking shaft includes a first shaft tab 660 at a first shaft end 662, a second shaft tab 664 at a second shaft end 666, an external shaft shoulder 668 and a set of locking teeth 670. Further, the bearing 658 includes an internal bearing shoulder 672 and an external bearing shoulder 674. Also, the sleeve 656 includes an end wall 676.

In the illustrated example of FIG. 6, the locking shaft 654 is disposed in and rotatably engaged with the sleeve 656 and the bearing 658. The sleeve 656 is engaged with the bearing 658 (e.g., threadably, adhered, press fit, etc.) to engage the second shaft end 666 with the end wall 676 and the external shaft shoulder 668 with the internal bearing shoulder 672. In other words, the locking shaft 654 is captured between the bearing 658 and the sleeve 656.

In the illustrated example of FIG. 6, the intermediate housing 622 is engaged with the trigger stop 118, the locking shaft assembly 120, the intermediate boot 624, and the axial spring 620. More specifically, trigger stop 118 is inserted into the intermediate housing 622. Further, more precisely, the sleeve 656 and the bearing 658 are engaged with the intermediate housing 622 to extend the locking shaft assembly 120 through the intermediate housing 622. Additionally, the bearing 658 extends through the axial spring 620. In some examples, the intermediate boot 624 is formed from a flexible elastomer (e.g., rubber, vinyl, silicone, etc.).

In the illustrated example of FIG. 6, the detent housing 610 is engaged with the axial spring 620, the radial anchor pins 616, the bearing 658, the radial levers 612, the detent buttons 618, and the grip 122. The axial spring 620 urges the detent housing 610 away from the intermediate housing 622. More specifically, the detent housing 610 is rotatably engaged with the bearing 658 via the slideway 630. The radial levers 612 are slidably engaged with the lip 632 of the detent housing 610 and selectively rotatably engaged with the external bearing shoulder 674 of the bearing 658. The radial springs 614 are respectively engaged with the radial anchor pins 616 and the radial levers 612 to urge the radial levers 612 toward the bearing 658. Thus, the bearing 658 is captured along the slideway 630 between the radial levers 612 and the internal detent shoulder 628. In other words, sliding movement of the locking shaft assembly 120 relative to the detent housing 610 is selectively blocked by the radial levers 612. Further, the axial spring 620 is captured between the detent housing 610 and the intermediate housing 622. The detent buttons 618 slidably extend through the detent housing 610 and are respectively pivotably engaged with the radial levers 612. Additional structures of and engagements between the detent housing 610, the radial levers 612, the radial springs 614, the detent buttons 618, and the bearing 658 will be described in greater detail in conjunction with FIGS. 7 and 8. The grip 122 is a flexible elastomer and permits depression of the detent buttons 618 through the grip 122.

In operation, the first portion 114 is grasped by a first hand (not pictured) via the grip 122 and the second portion 116 is grasped by a second hand (not pictured) via the receiver boot 636. When opposing detent buttons 618 are depressed by the first hand via the grip 122, the radial levers 612 are pushed to stretch the radial springs 614 and disengage from the bearing 658. Thus, the bearing 658 is freed to slide along the slideway 630. Further in operation, once the radial levers 612 are cleared to free the bearing 658, the weapon lock 112 is compressed between the first and second hands to push the detent housing 610 toward the intermediate housing 622, thus compressing the axial spring 620. It should be understood that the second hand provides a reaction force against the first hand to compress the axial spring 620. Thus, the second hand is unavailable to depress the detent buttons 618 while compressing the axial spring 620. Accordingly, this must be done by a single hand, which, if the detent buttons 618 are sufficiently space apart around the detent housing 610, prevents access by children with smaller hands. When the detent housing 610 approaches the intermediate housing 622, the detent tab 626 engages the first shaft tab 660. Further in operation, while maintaining compression of the axial spring 620 to engage the detent tab 626 with the first shaft tab 660, the detent housing 610 is rotated with the first hand relative to the intermediate housing 622 and to the second hand. Thus, the locking shaft 654 is rotated in the sleeve 656.

In the illustrated example of FIG. 6, the receiver housing 634 is engaged with the sleeve 656 via the first cavity 212, the trigger stop 118 via the second cavity 214 the pawl 638, the pawl spring 640, the lock plate 642, the lock plate fastener 644, the key lock 124, and the receiver boot 636. More specifically, the lock plate fastener 644 is threadably engaged with the receiver housing 634 to fasten the lock plate 642 to the receiver housing 634. Further, the lock plate 642 is rotatably engaged with the lock plate fastener 644 and the receiver housing 634. In the illustrated example of FIG. 6, the catch 652 is engaged with the second shaft tab 664. Additionally, the pawl spring 640 is engaged with the pawl 638 to urge the pawl 638 toward the locking shaft 654 to engage (e.g., interlock) the set of pawl teeth 648 with the set of locking teeth 670. More specifically, the pawl 638 is slidably engaged in the pawl slot 646. Further, the pawl tab 650 is slidably engaged with the pawl slot 646 to substantially counteract rotation of the pawl 638 relative to the receiver housing 634 caused by the pawl spring 640. Also shown in FIG. 6, the key lock 124 is threadably engaged with the receiver housing 634. The key lock 124 is further selectively engaged with the lock plate 642 as will be explained in greater detail in conjunction with FIG. 9. In some examples, the receiver boot 636 is formed of a flexible elastomer.

In operation, when the locking shaft 654 is turned in the sleeve 656, as described above, the set of locking teeth 670 are disengaged from the set of pawl teeth 648 and the second shaft tab 664 rotates the lock plate 642 via the catch 652. Thus the locking shaft 654 is freed from the pawl 638. In operation, once the locking shaft 654 is freed from the pawl 638, the sleeve 656 and the trigger stop 118 may be respectively slid out of the first cavity 212 and the second cavity 214 to separate the first portion 114 from the second portion 116. It should be appreciated that the multiple steps and dexterity needed to depress opposing detent buttons 618 positioned at a diameter approaching an adult housing, compress the detent housing 610 toward the intermediate housing 622, and rotate the detent housing 610 relative to the intermediate housing 622 while engaging the detent tab 626 with the first shaft tab 660 substantially prevent a child from unlocking the weapon lock 112 from a weapon (e.g., the example weapon 312 of FIGS. 3 and 5) while allowing relatively quick access to the weapon to an adult. Optionally, when the key lock 124 is engaged with the lock plate 642, the catch 652 substantially prevents rotation of the locking shaft 654 in the sleeve 656 via the second shaft tab 664. Thus, when the key lock 124 is engaged with the lock plate 642, the set of locking teeth 670 are substantially prevented from disengaging from the set of pawl teeth 648. Thus, when the key lock 124 is engaged with the lock plate 124, children and unauthorized adults are substantially prevented from unlocking the weapon lock 112.

In operation, when the locking shaft assembly 120 and the trigger stop 118 are respectively inserted into the first cavity 212 and the second cavity 214, the set of locking teeth 670 ratchetingly engage the set of pawl teeth 648. Thus, the weapon lock 112 is locked.

Figure 7:
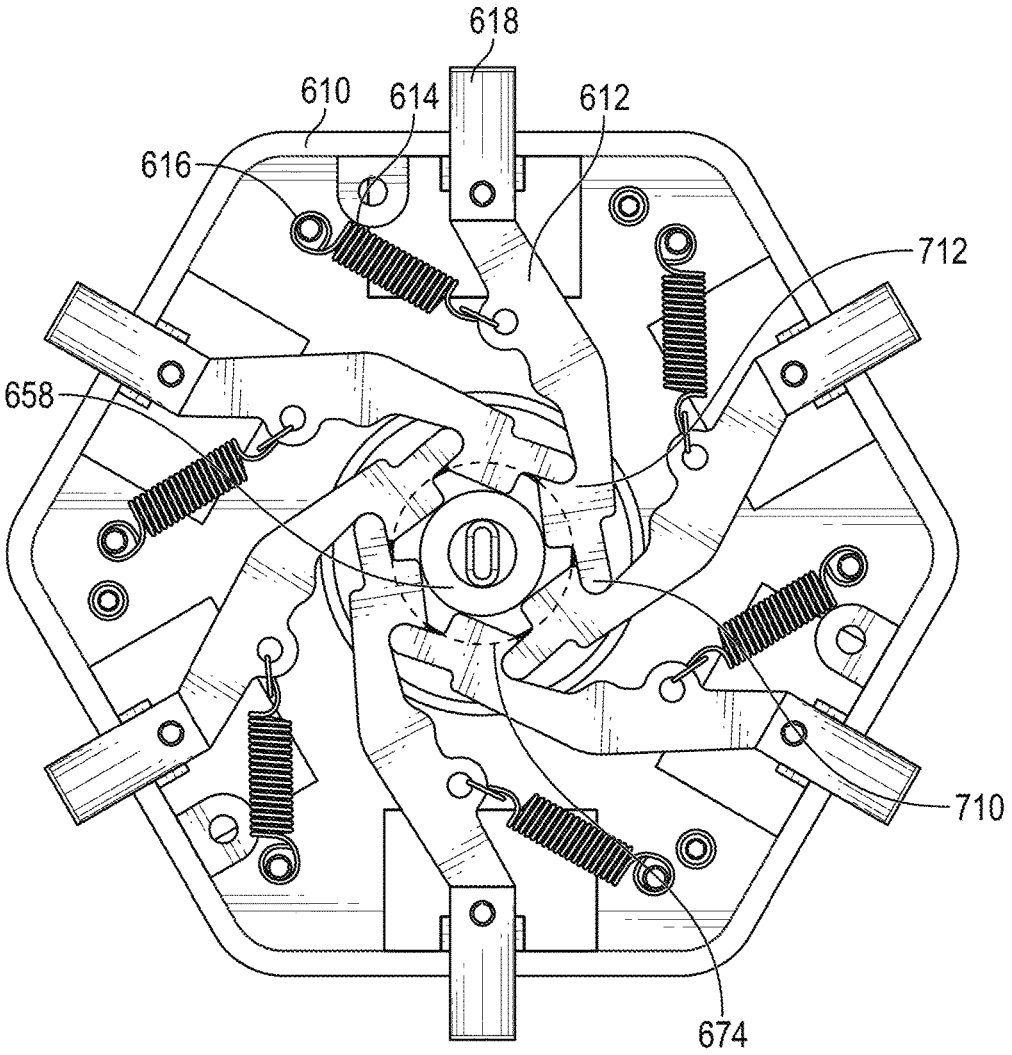
FIG. 7 is a cut-away view of a detent housing of FIG. 6 in a locked state.

FIG. 7 is a cut-away view of the detent housing 610 of FIG. 6 in a locked state. In the illustrated example of FIG. 7, the radial levers 612 each respectively have a lever tab 710 and a lever hook 712. As shown in FIG. 7, the lever tabs 710 interlock with the lever hooks 712 of neighboring radial levers 612. As described above, the radial springs 614 urge the radial levers 612 to engage one another and the external bearing shoulder 674 (shown partially dashed) of the bearing 658. Thus, the bearing 658 is captured in the detent housing 610.

Figure 8:
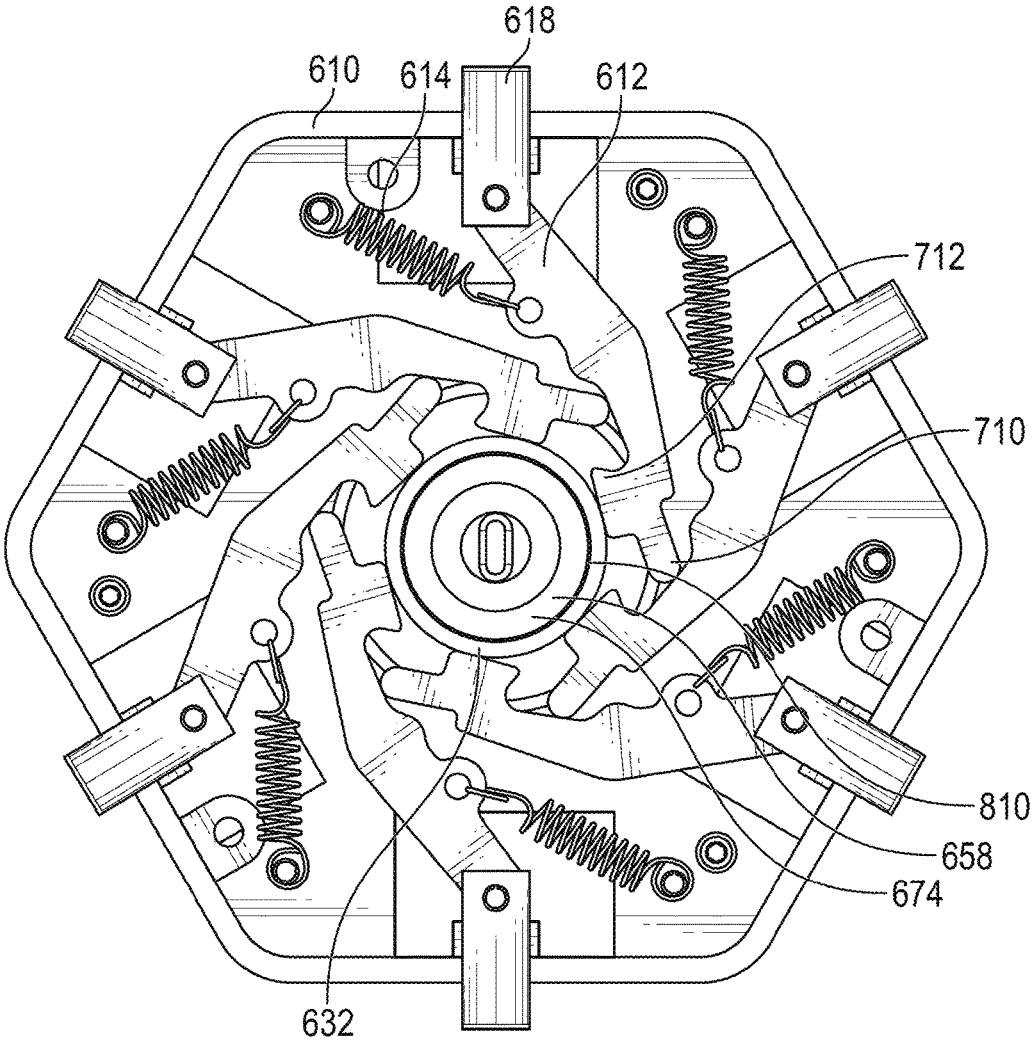
FIG. 8 is a cut-away view of the detent housing of FIGS. 6 and 7 in an unlocked state.

FIG. 8 is a cut-away view of the detent housing 610 of FIGS. 6 and 7 in an unlocked state. In the illustrated example of FIG. 7, the detent buttons 618 are depressed inwardly relative to the detent housing 610 to push on the radial levers 612. Thus, in operation, the radial springs 614 are stretched and each one of the radial levers 612 pushes the hook 712 of the neighboring radial lever 612 via the lever tab 710. In other words, depression of the detent buttons 618 causes the plurality of radial levers 612 to dilate outwardly. Thus, the radial levers 612 disengage from the external bearing shoulder 674 of the bearing 658. As shown in FIG. 8, a clearance gap 810 remains between the bearing 658 and the lip 632. Thus, in operation, with the radial levers 612 dilated away from the external bearing shoulder 674, the bearing 658 is free to slide in the detent housing 610 via the clearance gap 810.

Figure 9:
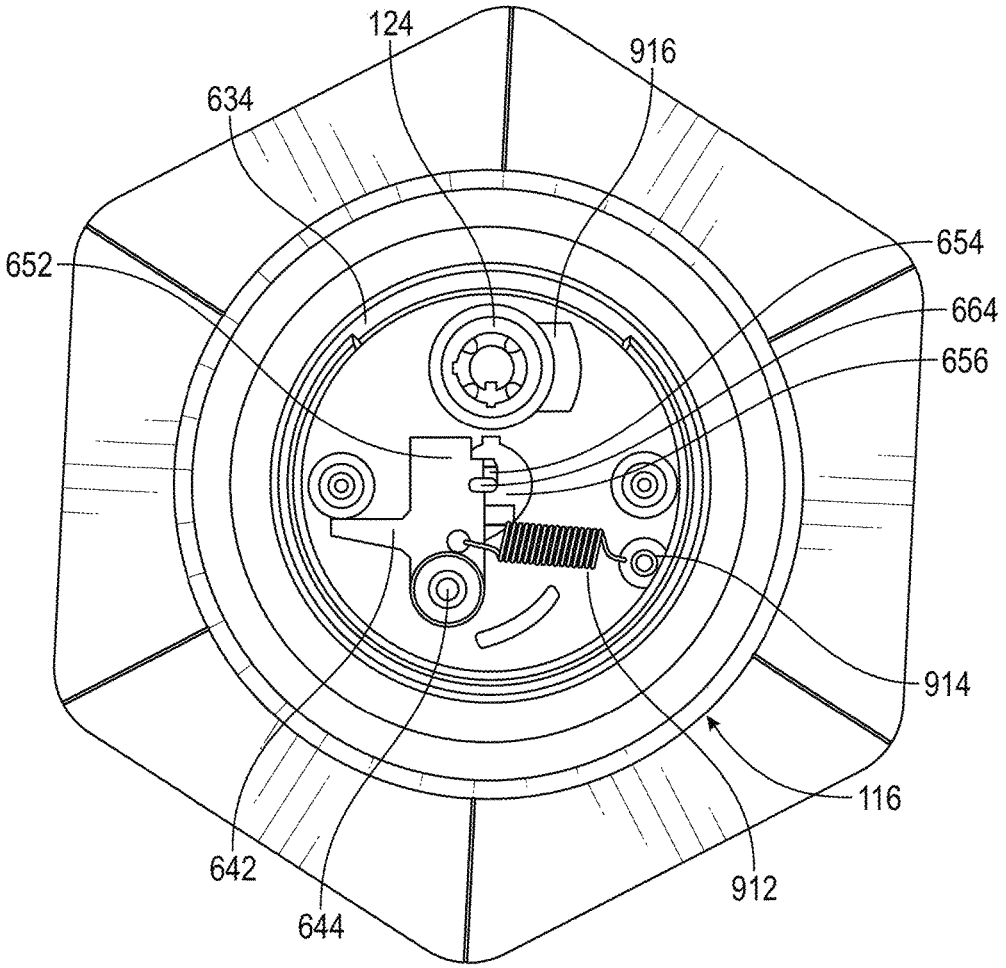
FIG. 9 is a cut-away view of a receiver housing of FIG. 6 with a key lock of FIGS. 1, 3, 5, and 6 in a locked state.

FIG. 9 is a cut-away view of the receiver housing 634 of FIG. 6 with the key lock 124 of FIGS. 1, 3, 5, and 6 in a key-locked state. In the illustrated example of FIG. 9, the second portion 116 further includes a key lock spring 912 and a key lock anchor pin 914. As shown in FIG. 9, the key lock 124 includes a key lock flange 916. The key lock spring is engaged with the lock plate 642 and the key lock anchor pin 914 to urge the catch 652 toward the second shaft tab 664. In the illustrated example of FIG. 9, the catch 652 is engaged with the second shaft tab 664. Thus, the locking shaft 654 is substantially prevented from rotating in the sleeve 656. Thus, the weapon lock 112 may be used in a child-resistant and adult-resistant key-locked state.

Figure 10:
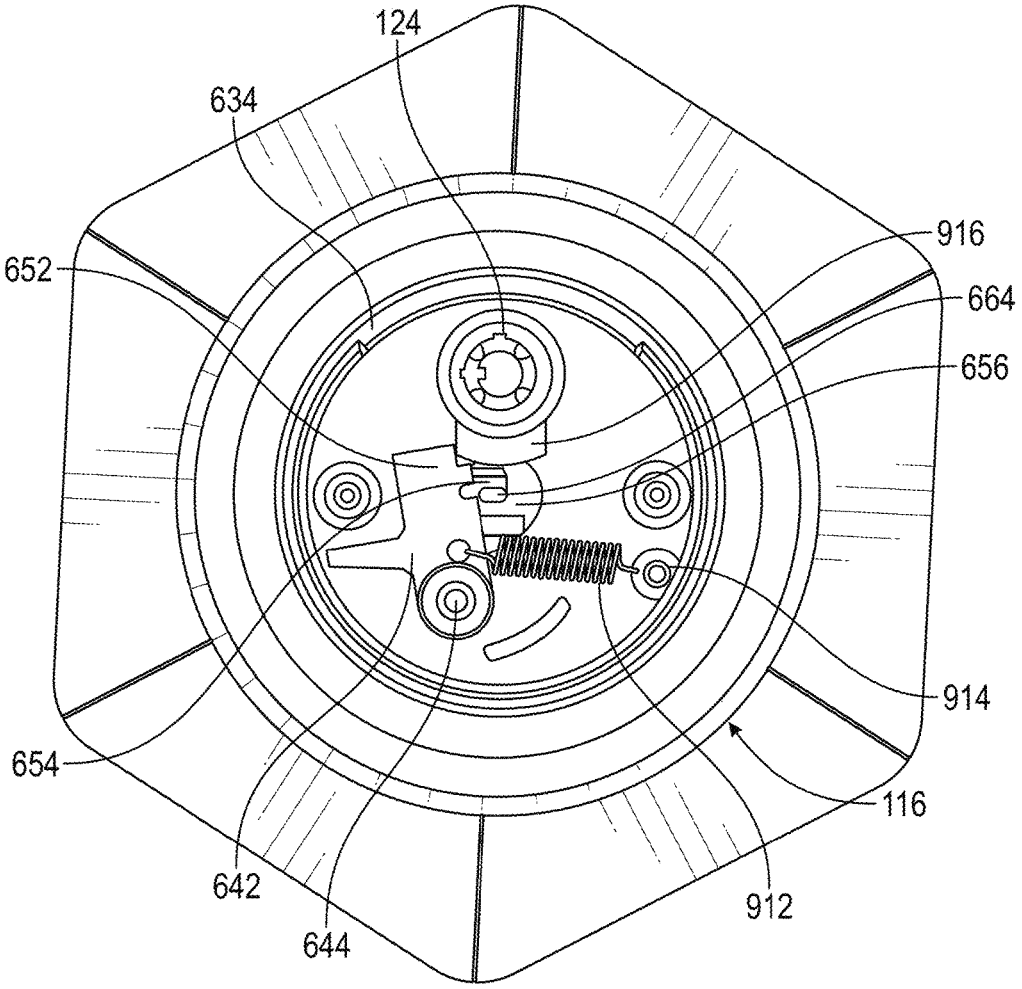
FIG. 10 is a cut-away view of the receiver housing of FIG. 6 with the key lock of FIGS. 1, 3, 5, and 6 in an unlocked state.

FIG. 10 is a cut-away view of the receiver housing of FIG. 6 with the key lock of FIGS. 1, 3, 5, and 6 in a key-unlocked state. As shown in FIG. 10, the key lock flange 916 is rotatably engaged with the receiver housing 634 and engaged with the lock plate 642. In operation, the key lock flange 916 may be rotated (e.g., with a key carried by an authorized adult) relative to the receiver housing 634 to engage the lock plate 642. As a result, the lock plate 642 rotates about the lock plate fastener 644 to stretch the key lock spring 912 and the catch 652 disengages from the second shaft tab 664. Thus, the locking shaft 654 is freed to rotate in the sleeve 656. Thus, the weapon lock 112 may be used with a weapon in a child-resistant key-unlocked state to provide quick access to the weapon to adults while substantially preventing children from accessing a trigger of the weapon.

Figure 11:
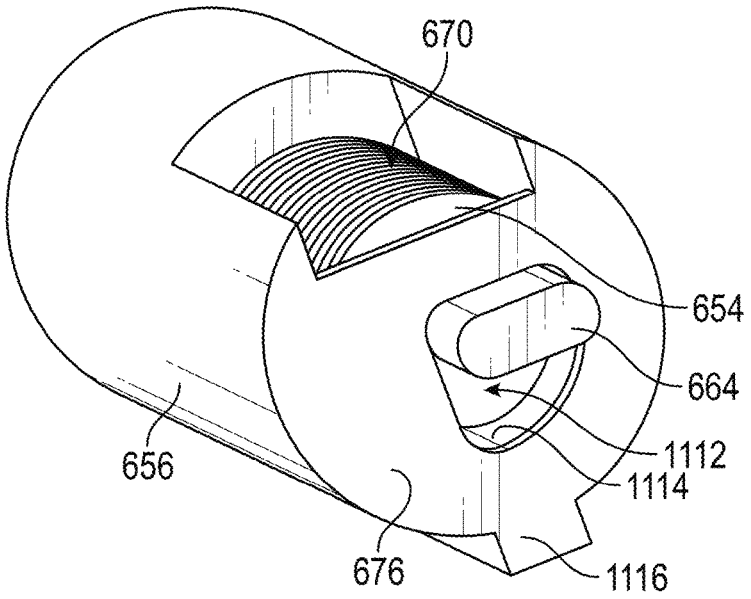
FIG. 11 is a more detailed view of a locking shaft and a sleeve of FIG. 6.

FIG. 11 is a more detailed view of the locking shaft 654 and the sleeve 656 of FIG. 6. In the illustrated example of FIG. 11, the sleeve 656 includes an end wall opening 1112 defined by an inner wall 1114 in the end wall 676. Further, as shown in the example of FIG. 11, the sleeve 656 includes a protrusion 1116 to interlock with the first cavity 212 of FIGS. 2 and 6. As shown in FIG. 11, the second shaft tab 664 extends through the end wall opening 1112. Further, as in the example of FIG. 11, the inner wall 1114 selectively engages the second shaft tab 664 to limit rotation of the locking shaft 654 relative to the sleeve 656. Additionally, the set of locking teeth 670 of the locking shaft 654 are arcuate, as illustrated in FIG. 11.

Figure 12:
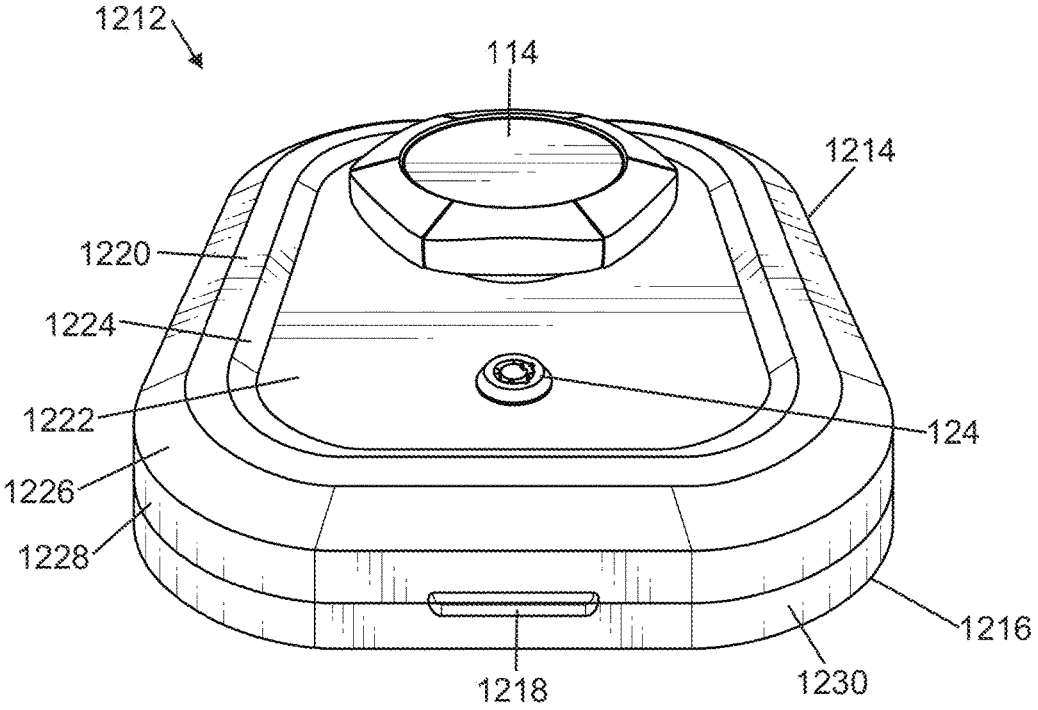
FIG. 12 is a perspective view of a weapon case in a closed configuration.

FIG. 12 is a perspective view of a weapon case 1212 in a closed configuration. In some examples, the weapon case 1212 is portable. In the illustrated example of FIG. 12, the weapon case 1212 includes a top shell 1214, a bottom shell 1216, the first portion 114, and the key lock 124. The top shell 1214 includes a gripping lip 1218, a first upper surface 1220, a second upper surface 1222, a first transition 1224, a second transition 1226, and a first outer perimeter 1228. The first upper surface 1220 is joined to the second upper surface 1222 via the first transition 1224. The first upper surface is joined to the first outer perimeter 1228 via the second transition 1226. The bottom shell 1216 includes a second outer perimeter 1230.

As depicted in FIG. 12, the first portion 114 and the key lock 124 are engaged with the top shell 1214 via the second upper surface 1222. The weapon case 114 may be opened by an adult by actuating the first portion 114 as described above (e.g., squeezing, pushing, and turning). Further, the weapon case 114 may be further secured in the closed configuration shown in FIG. 12 via the key lock 124 as described above. The gripping lip 1218 provides a finger hold to facilitate opening of the weapon case 1212 by an authorized adult.

Figure 13:
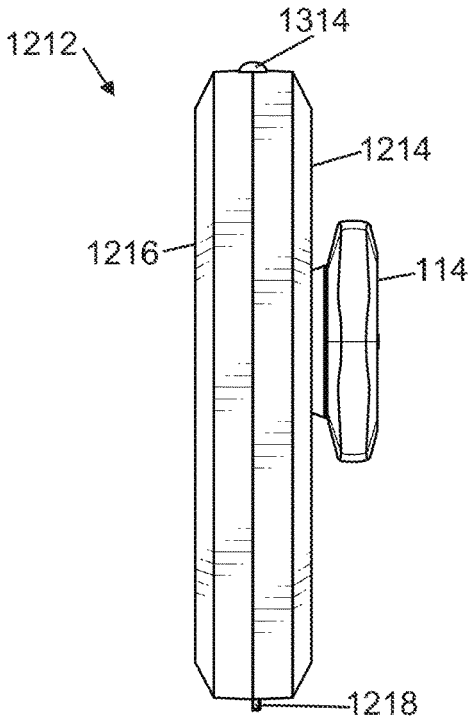
FIG. 13 is a side view of the weapon case of FIG. 12.

FIG. 13 is a side view of the weapon case 1212 of FIG. 12. In the illustrated example of FIG. 13, the weapon case 1212 includes a hinge 1314. The hinge 1314 swingably joins the top shell 1214 to the bottom shell 1216.

Figure 14:
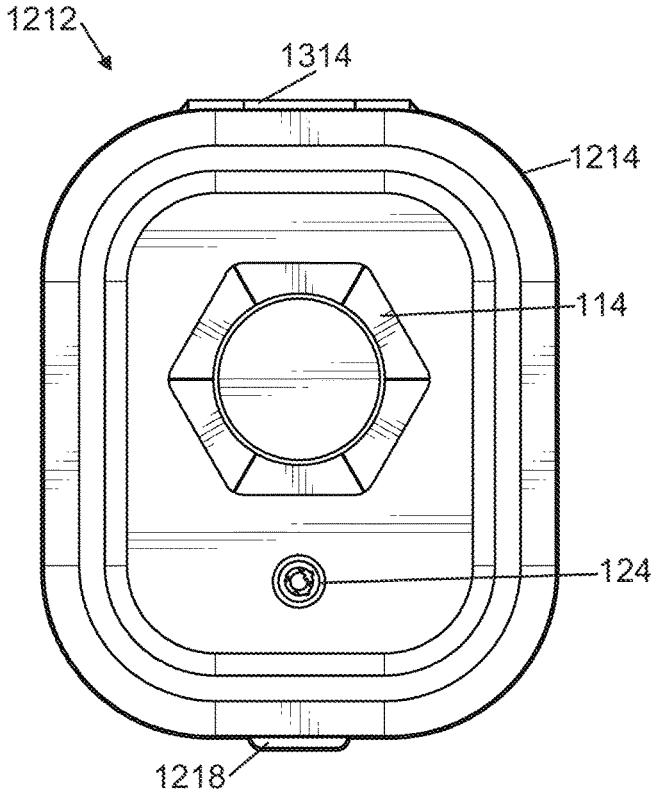
FIG. 14 is a top view of the weapon case of FIG. 12.

FIG. 14 is a top view of the weapon case 1212 of FIG. 12. In the illustrated example of FIG. 14, the hinge 1314 is located on the weapon case 1212 opposite the gripping lip 1218. In the example of FIG. 14, the first portion 114 is located between the key lock 124 and the hinge 1314. Further, in the example of FIG. 14, the key lock 124 is located between the first portion 114 and the gripping lip 1218. It should be understood that the hinge 1314, the gripping lip 1218, the first portion 114, and the key lock 124 may differently arranged relative to one another in alternative embodiments of the weapon case 1212.

Figure 15:
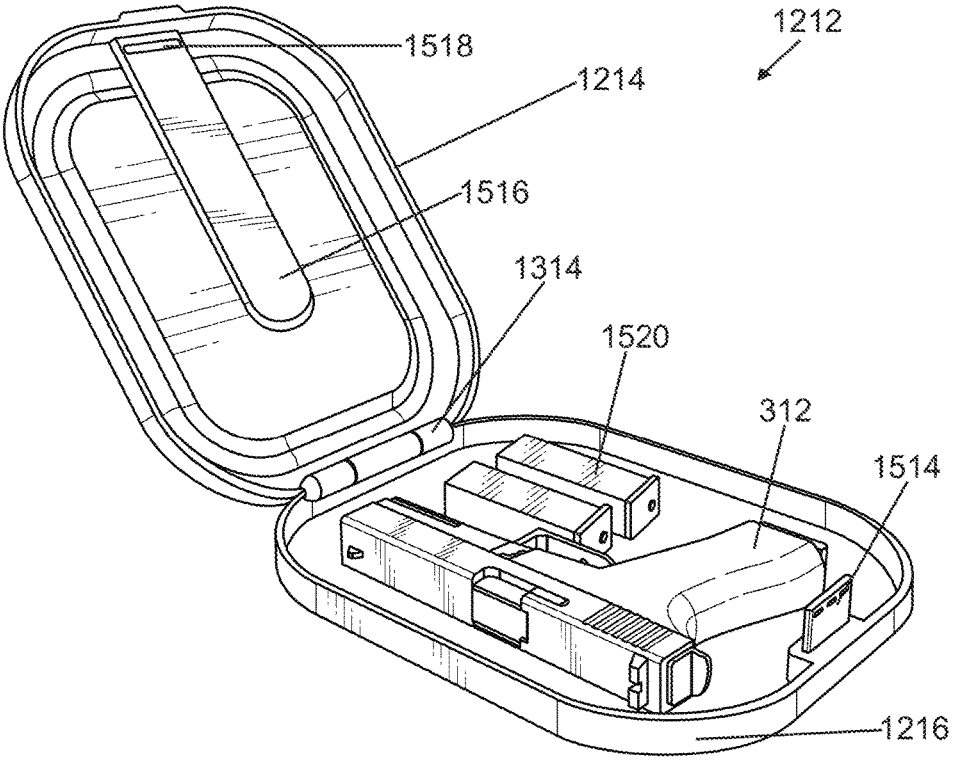
FIG. 15 is a perspective view of the weapon case of FIG. 12 in an open configuration.

FIG. 15 is a perspective view of the weapon case 1212 of FIG. 12 in an open configuration. In the illustrated example of FIG. 15, the bottom shell 1216 includes a latch 1514. In the illustrated example of FIG. 15, the top shell 1214 includes a linkage housing 1516. The linkage housing 1516 includes a latch cavity 1518 to receive the latch 1514. The linkage housing 1516 houses a linkage (not shown) engaged with the first portion 114. When the first portion 114 is actuated properly by an adult-sized hand, the linkage releases the latch 1514 from the latch cavity 1518 to enable opening of the weapon case 1212. In other words, when the first portion 114 is squeezed, pushed toward the bottom shell 1216, and rotated, the latch 1514 is freed from the latch cavity 1518 to allow transition of the weapon case 1212 from the closed configuration of FIGS. 12-14 to the open configuration of FIG. 15. As shown in FIG. 15, the weapon case 1212 may secure the firearm 312 and/or magazines 1520.

Figure 16:
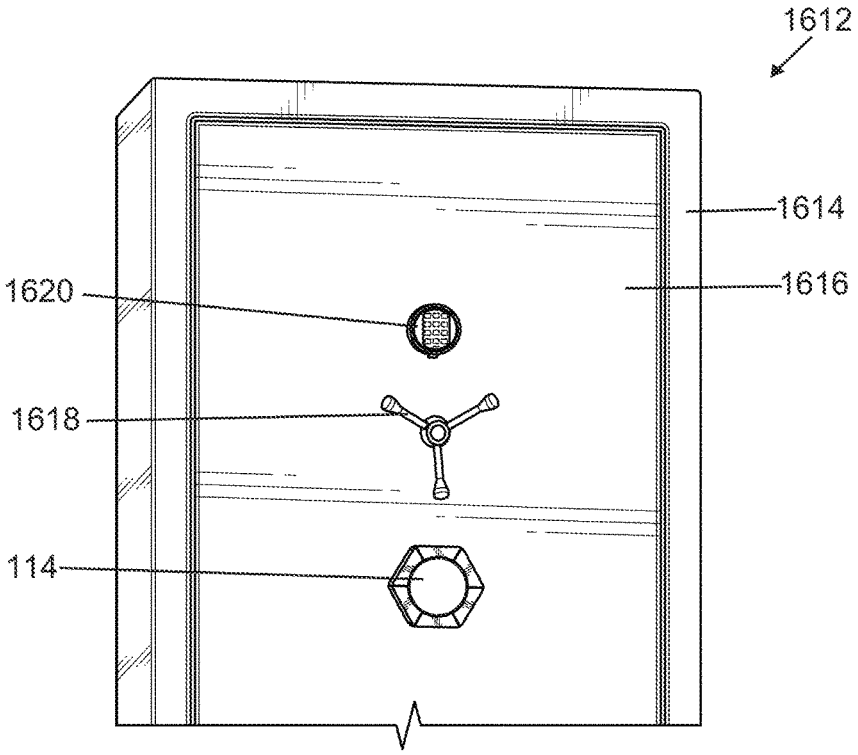
FIG. 16 is a front view of a weapon cabinet.

FIG. 16 is a front view of a weapon cabinet 1612. In some examples, the weapon cabinet 1612 is stationary. In the illustrated example of FIG. 16, the weapon cabinet 1612 includes a cabinet housing 1614, a door 1616, a handle assembly 1618, a keypad 1620, and the first portion 114. As shown in FIG. 16, the first portion 114, the handle assembly 1618, and the keypad 1620 are engaged with the door 1616. The door 1616 is lockable to the cabinet housing 1614 via a linkage (not shown in FIG. 16) engaged with the first portion 114 and with the handle assembly 1618. The door 1616 may be optionally additionally secured to the cabinet housing 1614 via the keypad 1620. The door 1616 may be opened by an adult hand by actuating the first portion 114 as described above (e.g., squeezing, pushing toward the door 1616, and rotating) and rotating the handle assembly 1616 to release the linkage from the cabinet housing 1616. When the door 1616 is additionally secured via the keypad 1620, a code is entered into the keypad 1620 to release the linkage from the cabinet housing 1614.

From the foregoing, it will be appreciated that the above disclosed methods and apparatus may aid in restricting children from accessing weapons while allowing quick weapon access to adults. Further, the above disclosed methods and apparatus may aid in restricting unauthorized adults from accessing weapons. Even more, the above disclosed methods and apparatus may improve weapon safety by substantially immobilizing weapon triggers.

Although certain example methods, apparatus, and articles of manufacture have been disclosed herein, the scope of coverage of this patent is not limited thereto. On the contrary, this patent covers all methods, apparatus, and articles of manufacture fairly falling within the scope of the claims of this patent.

What is claimed is:

1. A safety apparatus for a weapon comprising:

a locking shaft assembly comprising a locking shaft, the locking shaft having a shaft tab;

a detent housing engaged with the locking shaft assembly, the detent housing comprising a detent tab to selectively engage the shaft tab to rotate the locking shaft; and a radial lever engaged with the detent housing and selectively engaged with the locking shaft assembly to selectively capture the locking shaft assembly between the radial lever and the detent housing.

2. The safety apparatus of claim 1, wherein the locking shaft assembly is rotatably engaged with the detent housing.

3. The safety apparatus of claim 1, further comprising an intermediate housing engaged with the locking shaft assembly and an axial spring engaged with the intermediate housing and the detent housing to urge the detent housing from the intermediate housing.

4. The safety apparatus of claim 3, further comprising a trigger stop engaged with the intermediate housing.

5. The safety apparatus of claim 4, further comprising an escutcheon engaged with the trigger stop to fill an aft space behind a trigger of the weapon.

6. The safety apparatus of claim 1, wherein the locking shaft assembly comprises a bearing rotatably engaged with the detent housing and the locking shaft.

7. An apparatus for locking a firearm comprising:

a locking shaft comprising a first shaft tab at a first shaft end of the locking shaft;

a bearing about and rotatably engaged with the locking shaft;

a detent housing rotatably engaged with the bearing and comprising a detent tab to engage the first shaft tab;

a radial lever engaged with the detent housing to selectively block sliding movement of the bearing in the detent housing;

an axial spring engaged with the detent housing to urge the detent housing away from the locking shaft; and a radial spring engaged with the detent housing and the radial lever to urge the radial lever toward the bearing.

8. The apparatus of claim 7, further comprising:

a sleeve engaged with the bearing and rotatably engaged with the locking shaft; and an intermediate housing engaged with the sleeve and with the axial spring.

9. The apparatus of claim 8, wherein the bearing comprises an internal bearing shoulder, the sleeve comprises an end wall, and the locking shaft is captured in the sleeve between the internal bearing shoulder and the end wall.

10. The apparatus of claim 9, wherein the locking shaft comprises a second shaft tab at a second shaft end, the end wall has an end wall opening, and the second shaft tab extends through the end wall opening.

11. The apparatus of claim 10, wherein an inner wall defining the end wall opening limits rotation of the locking shaft relative to the sleeve.

12. The apparatus of claim 10, further comprising a lock plate to engage the second shaft tab.

13. An apparatus for locking a firearm comprising:

a locking shaft comprising a first shaft tab at a first shaft end of the locking shaft and a second shaft tab at a second shaft end of the locking shaft opposite the first shaft end;

a bearing about and rotatably engaged with the locking shaft;

a detent housing rotatably engaged with the bearing and comprising a detent tab to engage the first shaft tab;

a radial lever engaged with the detent housing to selectively block sliding movement of the bearing in the detent housing;

an axial spring engaged with the detent housing to urge the detent housing away from the locking shaft; and a lock plate to engage the second shaft tab.

14. The apparatus of claim 13, further comprising a sleeve engaged with the bearing and rotatably engaged with the locking shaft.

15. The apparatus of claim 14, further comprising an intermediate housing engaged with the sleeve and with the axial spring.

16. The apparatus of claim 14, wherein the bearing includes an internal bearing shoulder, the sleeve includes an end wall, and the locking shaft is captured in the sleeve between the internal bearing shoulder and the end wall.

17. The apparatus of claim 16, wherein the end wall has an end wall opening, and the second shaft tab extends through the end wall opening.

18. The apparatus of claim 17, wherein an inner wall defining the end wall opening limits rotation of the locking shaft relative to the sleeve.

19. The apparatus of claim 13 further comprising a radial spring engaged with the detent housing and the radial lever to urge the radial lever toward the bearing.

* * * * *